US009681764B1

(12) United States Patent
Boynton

(10) Patent No.: US 9,681,764 B1
(45) Date of Patent: Jun. 20, 2017

(54) FOLDABLE CHAIR BLANKET

(71) Applicant: Stephanie Boynton, Simi Valley, CA (US)

(72) Inventor: Stephanie Boynton, Simi Valley, CA (US)

( * ) Notice: Subject to any disclaimer, the term of this patent is extended or adjusted under 35 U.S.C. 154(b) by 0 days.

(21) Appl. No.: 15/205,986

(22) Filed: Jul. 8, 2016

Related U.S. Application Data

(63) Continuation of application No. 13/736,714, filed on Jan. 8, 2013, now abandoned, which is a continuation-in-part of application No. 13/557,133, filed on Jul. 24, 2012, now abandoned.

(60) Provisional application No. 61/572,944, filed on Jul. 25, 2011, provisional application No. 61/632,953, filed on Feb. 2, 2012.

(51) Int. Cl.

| | |
|---|---|
| ***A47G 9/06*** | (2006.01) |
| ***A47C 4/00*** | (2006.01) |
| ***A47C 7/54*** | (2006.01) |
| ***A47C 7/02*** | (2006.01) |

(52) U.S. Cl.
CPC ..... *A47G 9/066* (2013.01); *A47C 4/00* (2013.01); *A47C 7/021* (2013.01); *A47C 7/54* (2013.01)

(58) Field of Classification Search
CPC ..... A47G 9/066; A47C 31/11
USPC ..... 5/420, 482, 486, 494, 496, 498; 2/69, 2/69.5, 46, 48, 114; 297/219.1, 229, 225
See application file for complete search history.

(56) References Cited

U.S. PATENT DOCUMENTS

| | | | | |
|---|---|---|---|---|
| 536,383 | A * | 3/1895 | Huyck | A47G 9/066 2/69.5 |
| 2,712,133 | A * | 7/1955 | Barndollar | A61G 5/10 2/69 |
| 4,826,242 | A * | 5/1989 | Trethewey | A47G 9/066 2/69 |
| D430,079 | S * | 8/2000 | Catron-Batts | D12/133 |
| 6,561,588 | B1 * | 5/2003 | Brady | B60N 2/28 297/188.01 |
| 6,757,922 | B2 * | 7/2004 | Chancey | A47G 9/066 2/69.5 |
| 6,764,134 | B1 * | 7/2004 | Crescenzi | A47C 31/00 2/69 |
| 7,003,825 | B1 * | 2/2006 | Levings | A47G 9/066 2/69.5 |
| 7,614,691 | B1 * | 11/2009 | Schmitz | A47C 7/021 297/219.1 |
| 2007/0052268 | A1 * | 3/2007 | Daniels | A47C 31/11 297/219.1 |
| 2010/0066131 | A1 * | 3/2010 | Smith | A47C 7/66 297/16.1 |
| 2010/0139001 | A1 * | 6/2010 | Mangano | A47C 7/383 5/636 |
| 2013/0328362 | A1 * | 12/2013 | Miller | A47C 7/62 297/188.2 |

* cited by examiner

*Primary Examiner* — Richard G Davis
(74) *Attorney, Agent, or Firm* — Colin P. Abrahams

(57) ABSTRACT

A blanket comprises a seat portion, a back portion, and an extended leg portion attached to the seat portion. The leg portion may be foldable and adjustable so that it can be used to cover the legs or other parts of the body, as desired.

14 Claims, 13 Drawing Sheets

FOLDABLE CHAIR BLANKET

CROSS REFERENCE TO RELATED APPLICATIONS

This application is a continuation application of U.S. patent application Ser. No. 13/736,714 Jan. 8, 2013, which is a continuation in part application of U.S. patent application Ser. No. 13/557,133 filed Jul. 24, 2012, which claims the benefit of U.S. Provisional Patent Application No. 61/572,944 filed Jul. 25, 2011, and U.S. Provisional Patent Application No. 61/632,953 filed Feb. 2, 2012, all of which are incorporated herein by reference in their entireties.

FIELD OF THE INVENTION

This invention relates to a foldable chair blanket which may be used in association with a chair, and is particularly useful when placed on a folding chair. However, the chair blanket of the invention may also be used in situations and contexts which do not involve the use of a chair or a folding chair. The chair blanket of the invention may either be in a folded or stored position, or it may be unfolded, at least to various degrees, so as to fit over a chair, other seating, or a flatter surface such as the ground. In this application, any reference to use of the blanket on a chair should be construed as including its use in other circumstances as well.

When mounted on the chair, the chair blanket of the invention may be configured so as to provide warmth and protection to the user.

SUMMARY OF THE INVENTION

According to one aspect of the invention, there is provided a blanket comprising a seat portion, a back portion, and an extended leg portion attached to the seat portion, the leg portion being foldable and adjustable so that it can be used to cover the legs or other parts of the body, as desired. The blanket may further comprise one or more pockets attached to the seat portion, wherein the pockets may swing over and hang from chair armrests. The blanket may be rolled or folded so as to be easily transportable, and also suitable for convenient storage purposes.

In one embodiment, at least the seat portion and the back portion have additional cushioning for the further comfort of the user. Further, the seat, back and leg portions may be of differing relative dimensions so that a particular blanket may be constructed to fit any one of a wide range of chairs having varied sizes and shapes. The blanket may further comprise at least one shoulder panel attached to the seat portion.

In a preferred embodiment, the blanket is configured for mounting on a chair, and the chair is preferably a folding chair having a seat portion, a back portion and a pair of lateral armrests. The blanket may have a slipcover for releasably sliding over the back portion of the chair.

In one embodiment, the back portion, seat portion and leg portion can be rolled up into a stored position, and the blanket further compromises a strap for holding the rolled up blanket in the stored position. In a further embodiment, the shoulder panels may be folded and tied so as to be configured into a pillow, head or neck rest.

The leg portion may comprise a base panel and a pair of lateral panels, the lateral panels being connected to the base panel along outer edges of the base panel respectively, the lateral panels having a fastening means along at least a part of a free edge thereof so that the lateral panels can be selectively fastened to each other to create at least a partially closed space between the base panel and the lateral panels. In a further embodiment, the lateral panels may be connected to the base panel along outer edges of the base panel respectively, the lateral panels being foldable over the base panel to create at least a partially closed between the base panel and the lateral panels.

According to a further aspect of the invention, there is provided a chair blanket comprising a seat portion, a back portion, and a blanket portion attached to the seat portion, the blanket portion being foldable and adjustable so that it can be used to cover the legs or other parts of the body, as desired.

Preferably, the chair blanket is configured for use on a folding chair. The blanket portion may comprise a base panel and a pair of lateral panels movable with respect to the base panel between a first position wherein the lateral panels at least partially cover the base panel to create and at least partially closed space and a second position wherein the lateral panels do not cover the base panel.

A foldable chair blanket or slipcover in accordance with the invention may fit all standard outdoor aluminum folding chairs or chairs comprised of other materials. The invention may also comprise a combination cushion and blanket for placement on a chair when needed, and folded, rolled and stored when not needed.

The chair blanket of the invention may have many design elements. It attaches easily over one or more of the top, back and seat of the chair and may be secured to the chair itself with Velcro tabs, straps or other suitable mechanisms. Lightly padded panels or a pillow headrest provide comfort to the neck and shoulder areas and may also provide lumbar support. Attached armrests sling over the chair's arms or hang from the sides and may contain pockets for storing miscellaneous items. The cover may also feature two side panels which, when zipped together, form a blanket for warmth and comfort for the legs and feet. When not zipped together, these panels can be folded up and used, as an example only, as a seat cushion. To store, the user may fold and roll up the entire unit and use a built-in strap, or an independent standalone strap, to conveniently carry it. The chair blanket of the invention may operate as a very convenient slipcover.

The chair blanket of the invention may be comprised of 100% cotton terry velour or 100% polyester micro plush fabrics, which may be super soft, durable and machine washable. In another version of the invention, the back and seat areas may be lined with ⅛" (or other thickness) foam backed tricot and secured with seven rows (or any such other convenient number) of top stitching spaced about 2½" (or such other convenient distance) apart. However, it should be appreciated that any suitable type of material or materials may be used in the construction of the blanket.

The shoulder and lumbar supports may have polyester fiber fill inside, and may be secured with top stitching. In one embodiment of the invention, a 30" plastic dual separating zipper functions with ease and will not be hot or cold to the touch while the cover is in use.

In one embodiment of the invention, the body measurements of the chair blanket may be 21½"W×74"L, although any other suitable and appropriate measurements may be used. These measurements preferably include the chair back, seat and leg extension. The zippered side panels may each measure about 17"×49". The armrests may measure about 11"W×21"L with pockets which may measure about 11"W×8" L. There may be two sets of Velcro tabs (1"×7") located on each side of the top headrest and at the intersection of the back and seat sections. Connected to the back panel is the 2½"×29" strap, although the strap may of course be of different dimensions. The fiber filled areas measure 11½" W×21½" L across the shoulder and the lumbar measures 5" W×21½" L. There may also be two shoulder panels each measuring 11" W×30" L.

All measurements and dimensions provided herein are examples only, and the blanket may be tailored or configured so as to be of any relative size or shape, to suit the selected use for the blanket.

Folding chairs may be used for many recreational and social gatherings. Some examples of such uses include: at the beach, camping, sporting events, dog and horse exhibitions, poolside, barbecues, and, the parade route. The present invention provides a foldable blanket which can be used with or on the chairs so as to facilitate additional warmth where needed, comfort and function. Made from polyester or cotton materials, for example, the blanket of the invention ensures durability, flexibility, and the ability to be machine washed. The cover may have a luxurious feel and may include embodiments so as to accommodate the higher backed chairs, the wider "director" and "umbrella" type chairs, as well as loungers, not to mention seating or bids of other types, structures and dimensions. The blanket may also be used on a flat or bed type chair, or even on the ground or other surface.

The folding blanket of the invention may have the effect of converting an ordinary standard aluminum chair into an extraordinarily cozy one with only minimal investment. The chair blanket of the invention may also be versatile and easy to use. The side panels zip up, down and may be selectively folded to adjust the degree of comfort required as the weather changes, thereby creating a comfortable, cozy environment for everyone, right down to the feet and toes. Further, there may be plenty of room to snuggle with pets. The shoulder panels may flip over as needed to guard and protect the upper body from drafts or cold. There are preferably one or more pockets placed on the folding blanket for containing miscellaneous items to be right there at the user's fingertips when needed. Additional enhancements could include more pockets for extra items and possibly pocket compartments for cold hands and feet. The chair blanket or blanket of the invention could also be easily adapted to slip over high backed chairs and loungers.

The target users may be women, men and children. In other words, the blanket of the invention may be used to advantage by many people regardless of gender or age, according to the situation. Further, the blanket of the invention can be used in many different types of environments, to protect the user against sun, cold, wind, or even moisture where a water resistant or waterproof version is used, as is possible in a further aspect of the invention.

BRIEF DESCRIPTION OF THE DRAWINGS

In the drawings:

FIG. 12(*b*) is a back schematic view of the open chair blanket illustrated in FIG. 12(*a*) of the drawings;

DETAILED DESCRIPTION OF THE INVENTION

Reference is now made to the accompanying drawings which show various forms and configurations of a chair blanket or foldable blanket or towel blanket in accordance with the present invention. Reference to any one of these should be considered to encompass the others. It is to be noted that the chair blanket of the invention may have particular application for use on various sizes and styles of folding chairs, but that the invention may be used on any type of chair or seating arrangement, without limitation. For example, the blanket of the invention may be used in a relatively flat surface, including on a beach or grassy surface.

Figure 1:
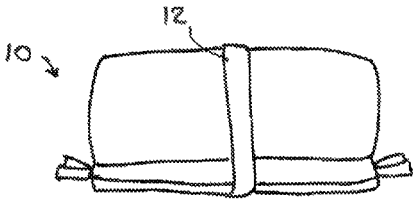
FIG. 1 of the drawings shows a chair blanket in accordance with one aspect of the invention, when in the folded condition.

FIG. 1 of the drawings shows a chair blanket 10 in accordance with the invention when in the folded or stored condition. The chair blanket 10 is retained in this position by means of a strap 12 appropriately located on the chair blanket 10. It should be noted that in this configuration, the chair blanket 10 may be used as a pillow.

Figure 2:
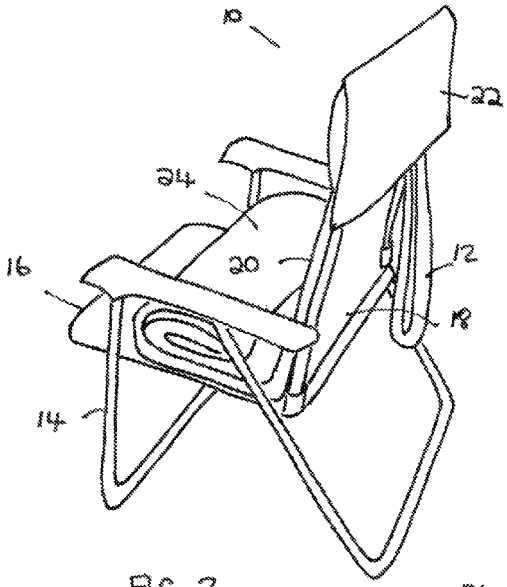
FIG. 2 is a rear perspective view of a folding chair with a chair blanket of the invention partially unfolded thereon.

FIG. 2 shows a chair blanket 10 partially mounted on a folding chair 14 which has a seat 16 and a back 18. The chair blanket 10 has a back component 20 with a slip cover or fold over portion 22 which fits over and releasably engages the back 18 of the folding chair 14. The chair blanket 10 further comprises a seat portion 24 shown in the rolled up position in FIG. 2 of the drawings.

Figure 3:
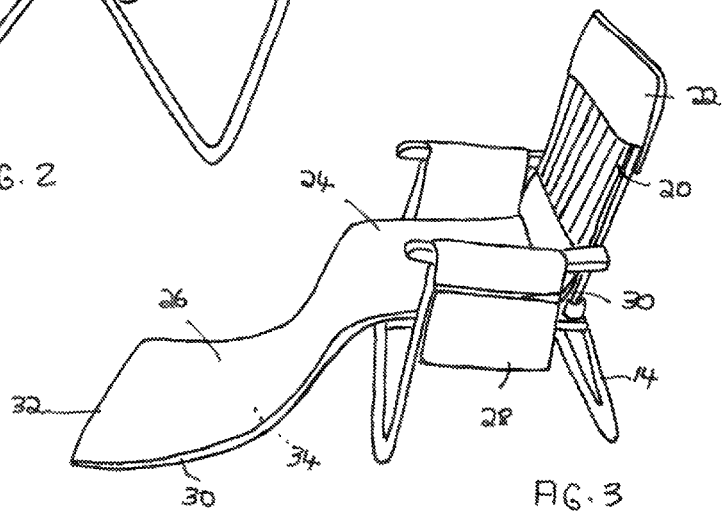
FIG. 3 is a side view of a chair of the type generally shown in FIG. 2 of the drawings with the chair blanket of the invention in the generally unfolded position and mounted on the chair.

FIG. 3 shows a chair blanket 10 mounted on a folding chair 14, including the back portion 20 with slip cover 22, a seat portion 24, and an extended leg portion 26, which is now shown in its unrolled, operational an extended configuration. Also shown in FIG. 3 are side pieces 28 with pockets 30. These are connected to the seat portion 24, and when the chair blanket 10 is unfolded, they may be thrown over the arms of the folding chair 14. The seat portion 24 and leg portion 26 are continuous in nature in one embodiment of the invention, and the leg portion 26 comprises a lower panel 30 and an upper panel 32, the lower panel 30 and upper panel 32 defining therebetween a space 34, shown in FIG. 4 of the drawings. In another embodiment of the invention, the seat portion 24 and leg portion 26 may comprise separate components or panels which have been joined together in a determined manner.

Figure 4:
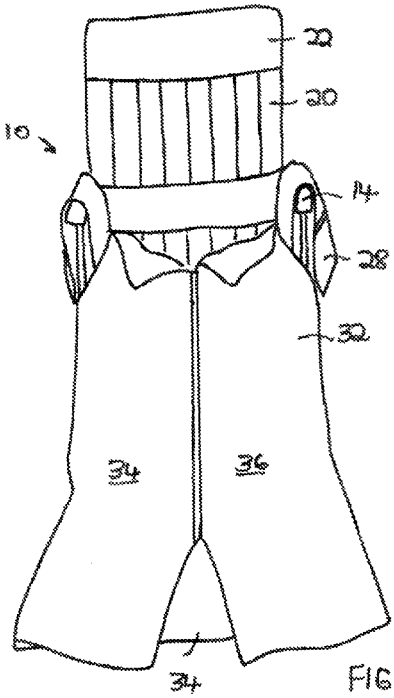
FIG. 4 is a front view of a chair of the type generally shown in FIG. 3 of the drawings showing the chair blanket of the invention mounted thereon in the unfolded position, and illustrating some of the panels connectable by a zipper.

FIG. 4 of the drawings shows a chair blanket 10 viewed from the front of the folding chair 14 on which it is located. It can be seen that the upper panel 32 is comprised of lateral panel 34 and lateral panel 36. These meet in substantially the center (or may be folded over each other in different embodiments), and may be releasably fastened to each other by means of a zipper 38. The zipper 38 may be opened from both the top and the bottom of the panels 34 and 36 so that the precise configuration of the lateral panels 34 and 36, including the extent to which the panels are open or closed with respect to each other, can be achieved for maximum comfort and convenience.

Figure 5:
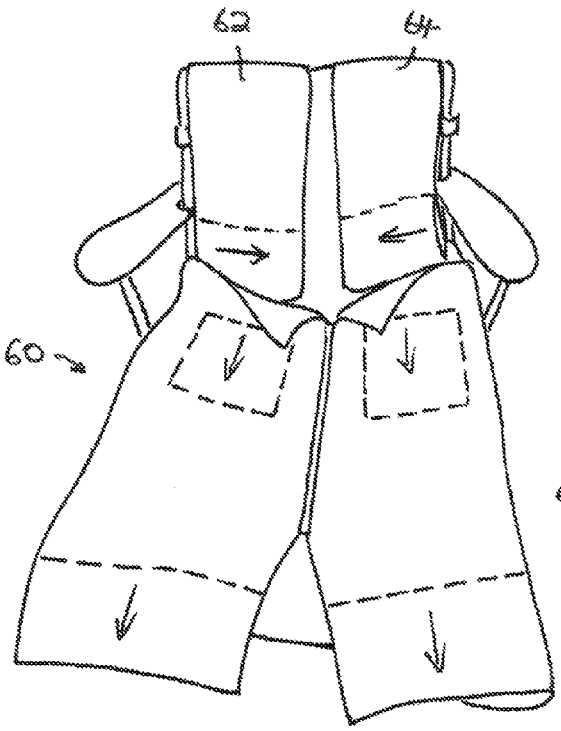
FIG. 5 is a front view of a chair blanket in accordance with a further embodiment of the invention, shown mounted on a folding chair.
Figure 6:
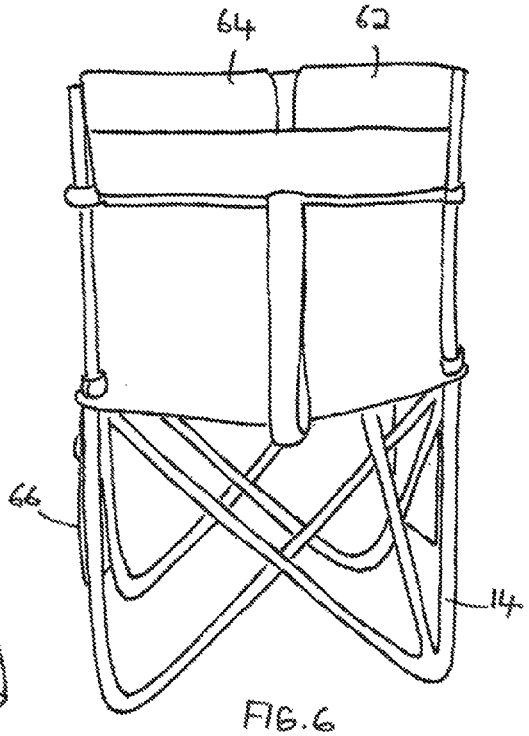
FIG. 6 is a rear view of the chair with the chair blanket of the invention as generally shown in FIG. 5 of the drawings.
Figure 7:
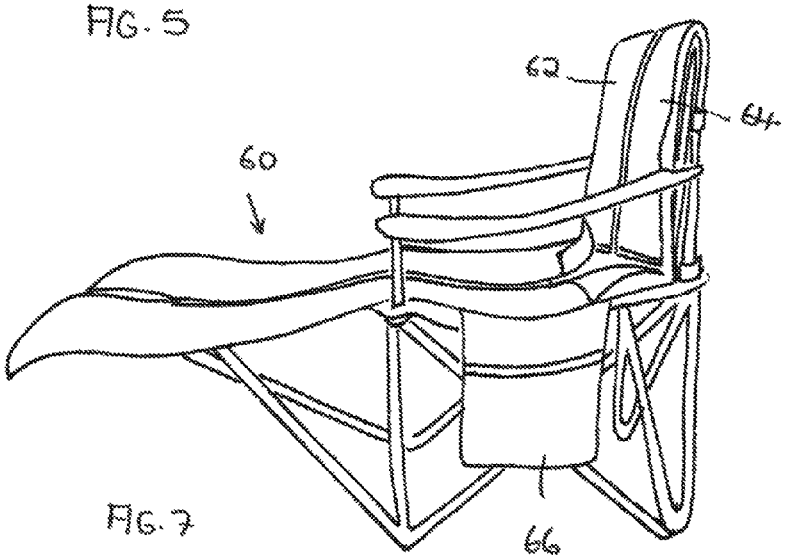
FIG. 7 is a perspective side view of the folding chair and chair blanket of the invention mounted thereon, illustrating the various panels, and a folding chair with an elevated or extended leg portion.

FIG. 5 of the drawings shows a front view of another embodiment of the chair blanket 60 of the invention. The chair blanket 60 does not, in this embodiment, contain side panels or pockets. However, the chair blanket 60 includes a pair of shoulder panels 62 and 64 for the user, if desired. FIGS. 6 and 7 show rear and side views of the chair blanket 60 illustrated in FIG. 5 of the drawings, including other features and elements, many of which have been discussed with respect to previously described embodiments. It will be seen in FIGS. 6 and 7 that side pockets are provided on each side of the seat portion, and hang downwardly therefrom. These pockets 66 can be folded and rolled away when the blanket 60 is converted to its stored or compacted position.

Figure 8:
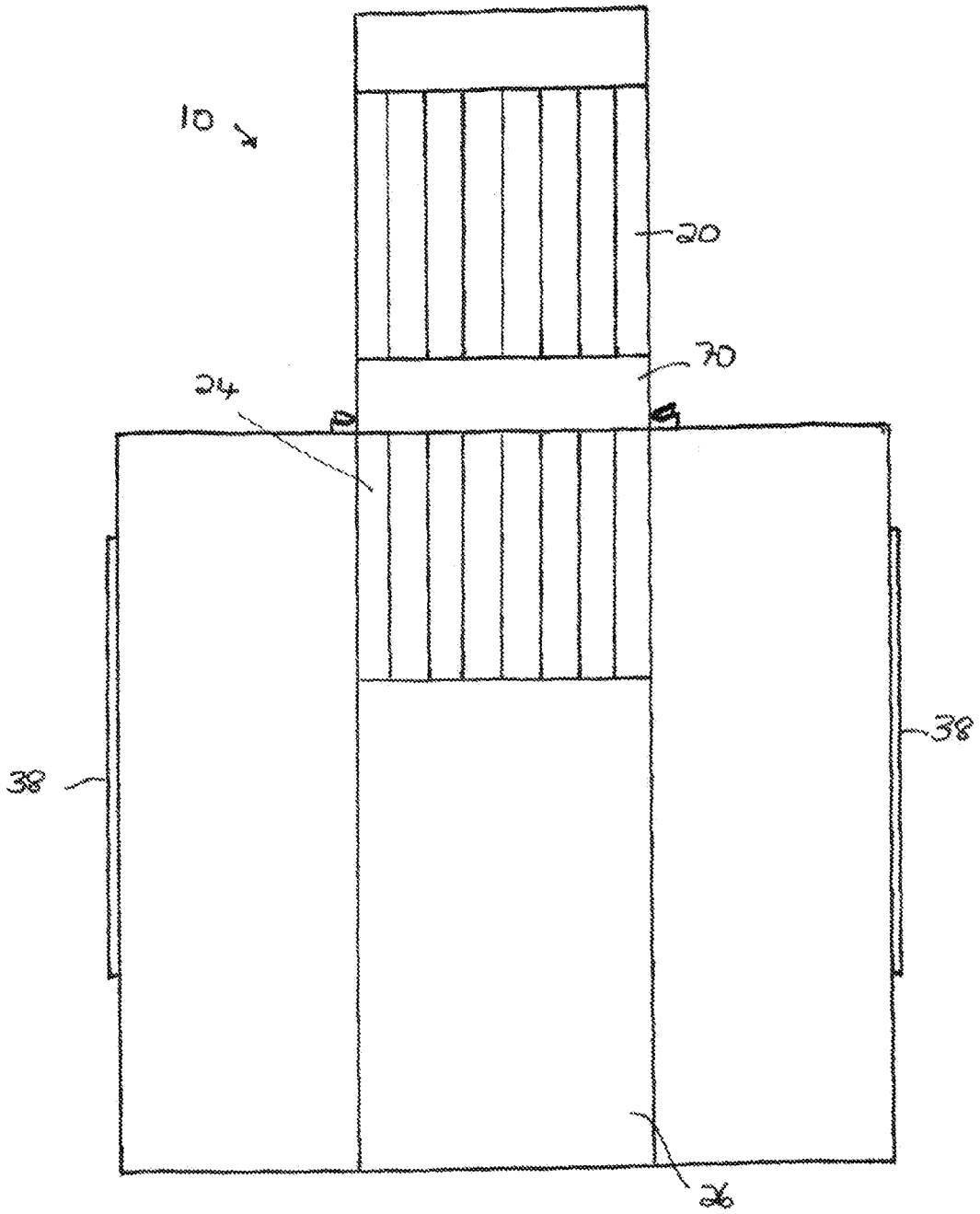
FIG. 8 is a schematic top view of an open chair blanket of the invention illustrating the various panels and components thereof.
Figure 9:
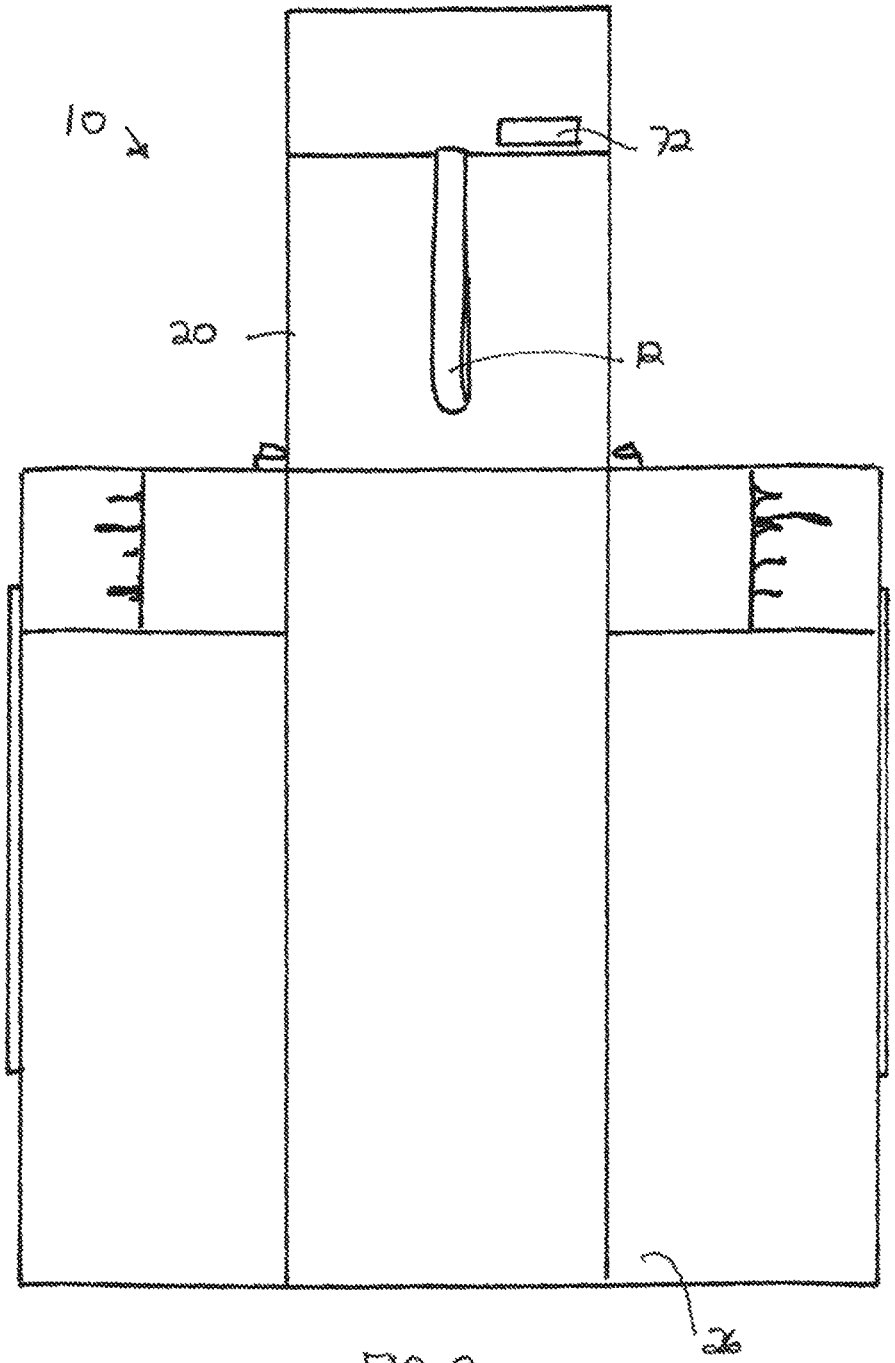
FIG. 9 is a schematic bottom view of the open chair blanket shown in FIG. 8 of the drawings.

FIGS. 8 and 9 of the drawings show schematic front and back views of the chair blanket 10 illustrating the various panels and components when in the unfolded condition. FIG. 8, the front view, shows those panels which may be visible when the chair blanket is mounted on the chair. FIG. 9, the back view, shows those surfaces of the panels which may be against the back and seat of the folding chair. FIG. 8 shows the presence of a lumbar support section 70. FIG. 9 shows the presence of a vinyl window 72 which may be used to insert identifying material, such as name of the owner, model or type of product, trade names or the like. FIGS. 8 and 9 also show the tabs by means of which the blanket 10 may be fastened to the chair so that it remains relatively fixed to the chair, so that movement or sliding thereof will be kept to a minimum, as long as the tabs are fastened. These figures also show the presence of the zipper 38 on each side of the lateral panels, the lateral panels being foldable so as to create the space, the zipper 38 joining the panels in a desired configuration selected by the user.

Figure 10:
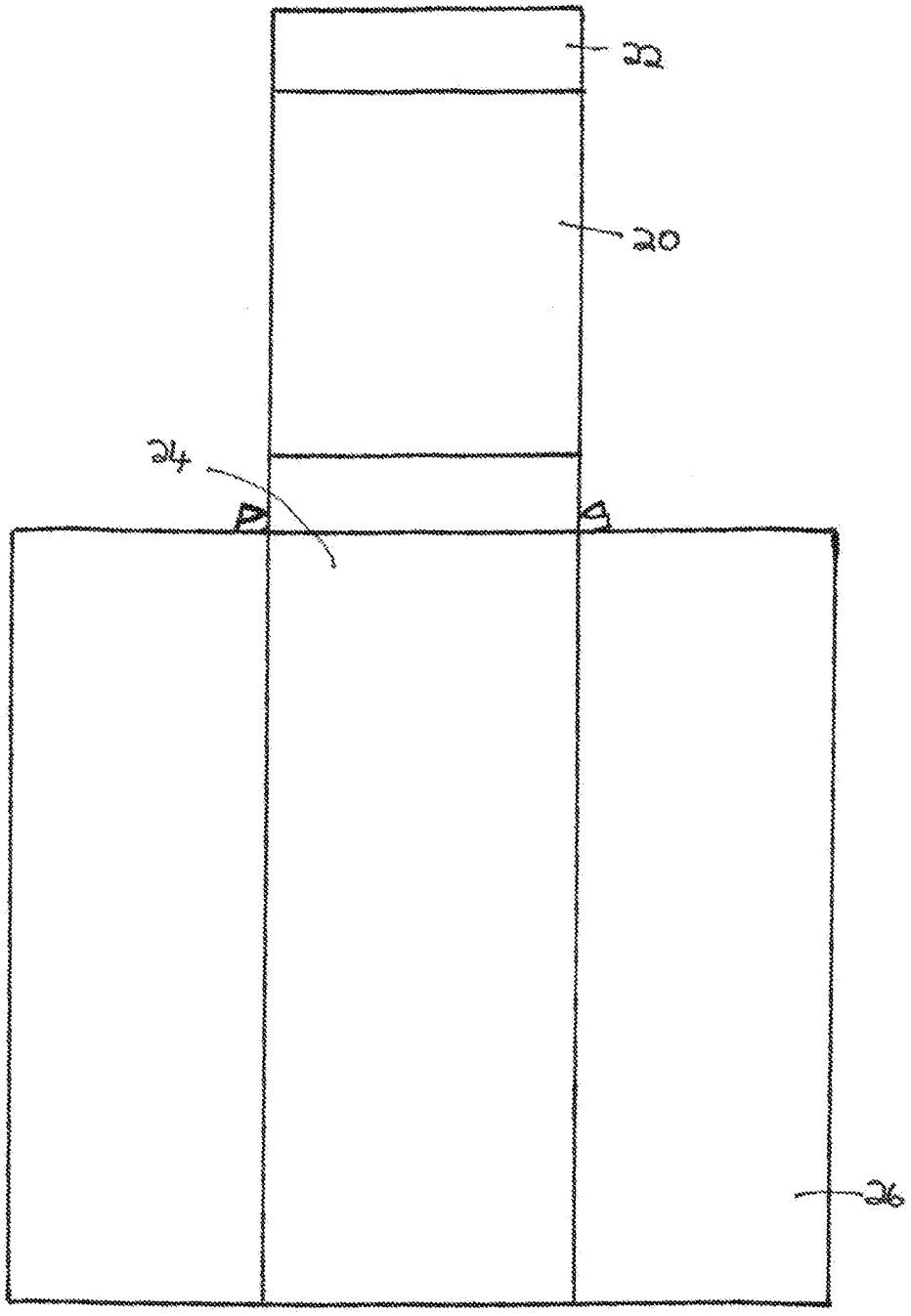
FIG. 10 is a schematic top view of an open chair blanket in accordance with a further embodiment of the invention designed for a high-back chair.
Figure 11:
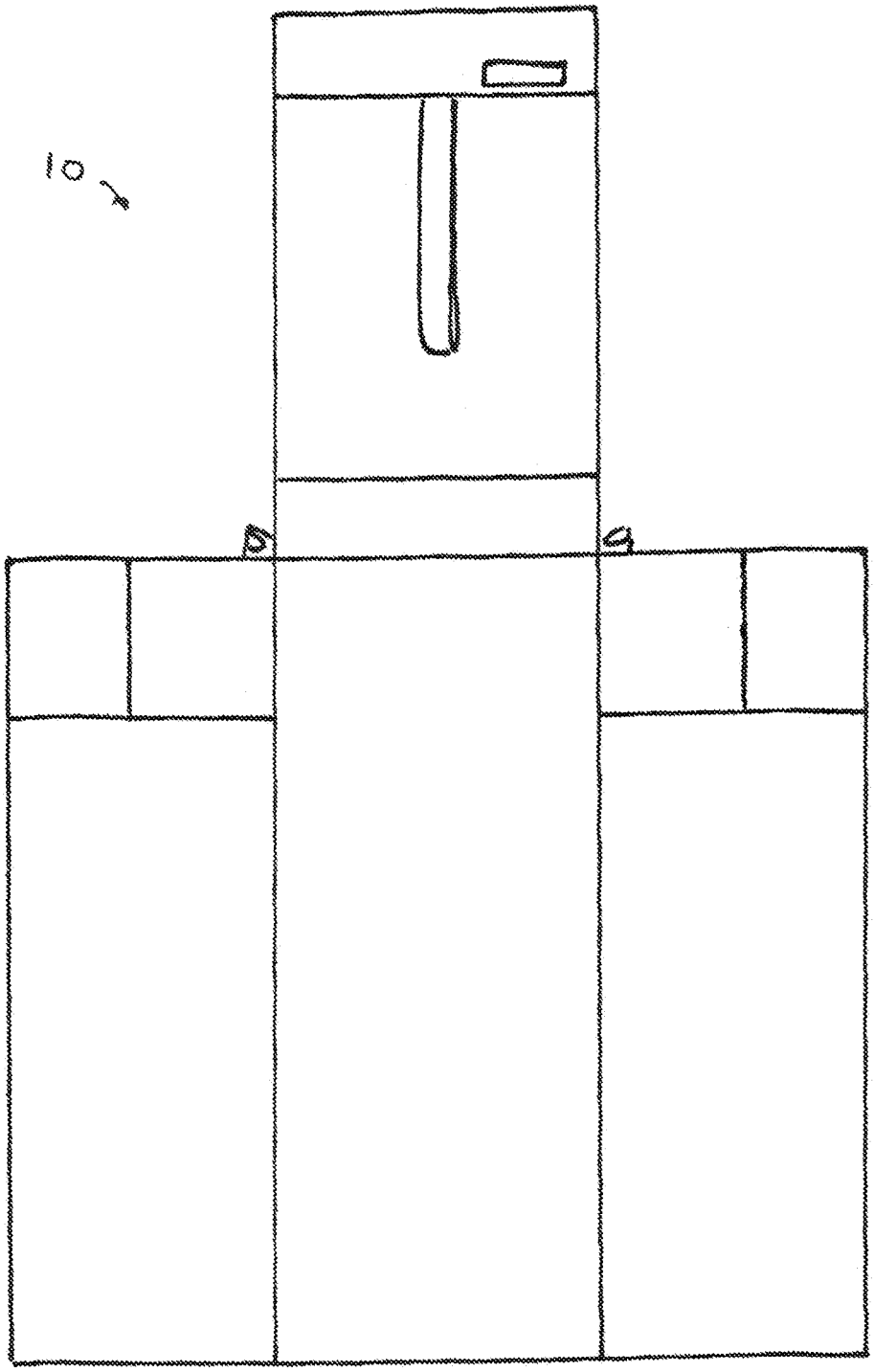
FIG. 11 is a schematic bottom or rear view of the chair blanket illustrated in FIG. 10 of the drawings, designed for the high-back chair.

FIGS. 10 and 11 show front and back views of a chair blanket of the invention in the open position. These chair blankets are designed for a high-back chair and therefore have a back portion which is somewhat longer than those designed for conventional back chairs. Further, the body of the cloth comprising the chair blanket may be a little wider, depending upon the chair for which it is designed. In these figures, the various panels and components are substantially the same in function as those described in previous embodiments, and the details will not be repeated. It should also be understood that, while these figures show different dimensions of the back portion, the blanket of the invention may have panels, shapes and components which may be varied in any number of a multitude of arrangements to suit a particular style or size chair, or any other seating or reclining object upon which the blanket may be mounted for the convenience of the user.

Note that FIG. 11 also shows the presence of the strap on the back portion of the blanket, the strap comprising ends which are sewn to the back portion and which define a loop. When the blanket is rolled, appropriate manipulation of the strap around the rolled blanket will have the effect of maintaining the rolled blanket in its stored or compacted position.

Figure 12A:
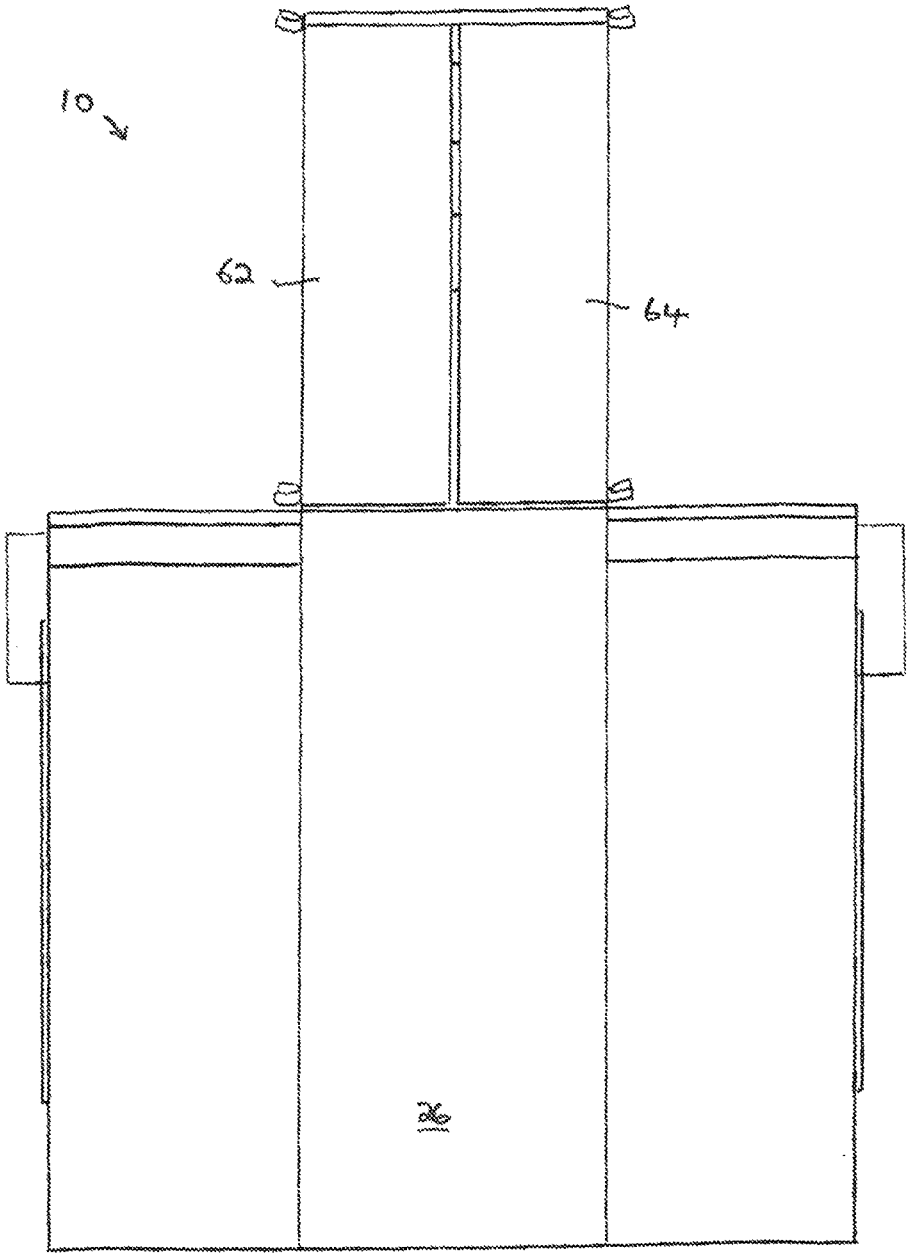
FIG. 12(*a*) is a top schematic view of an open chair blanket in accordance with yet a further embodiment of the invention, including shoulder panels.
Figure 12B:
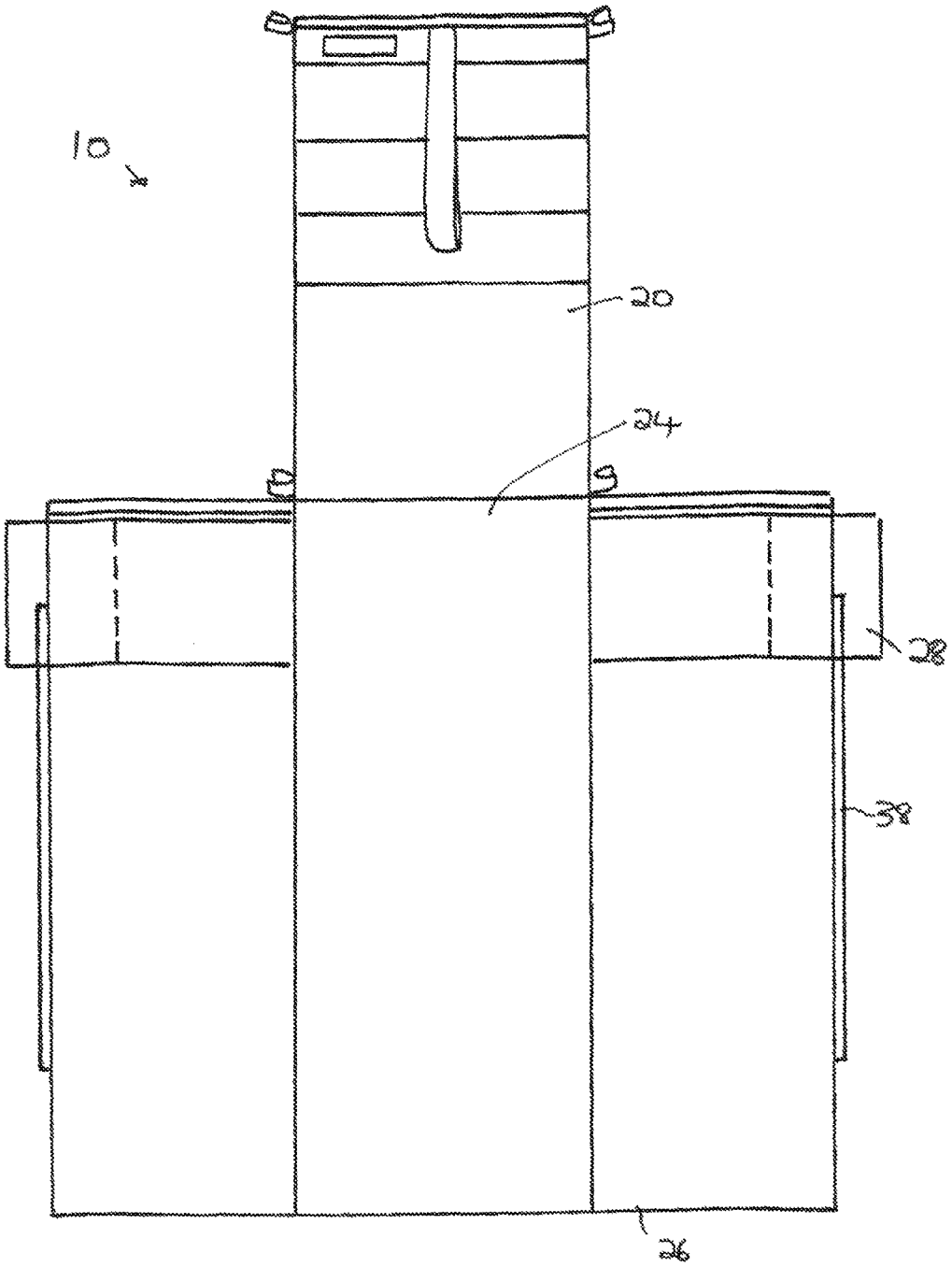
Figure 13:
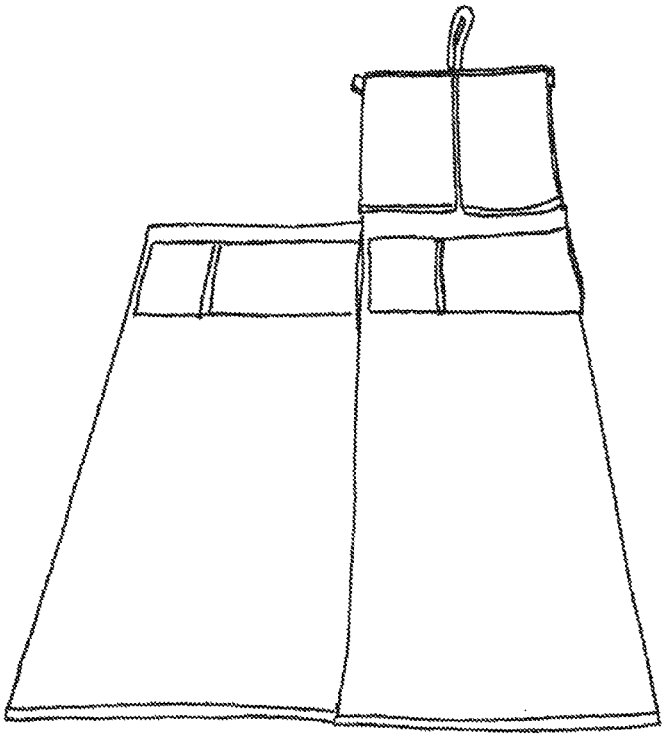
FIG. 13 is a top view of a chair blanket in accordance with one aspect of the invention which illustrates reversible patterns of the blanket on different sides thereof.
Figure 14:
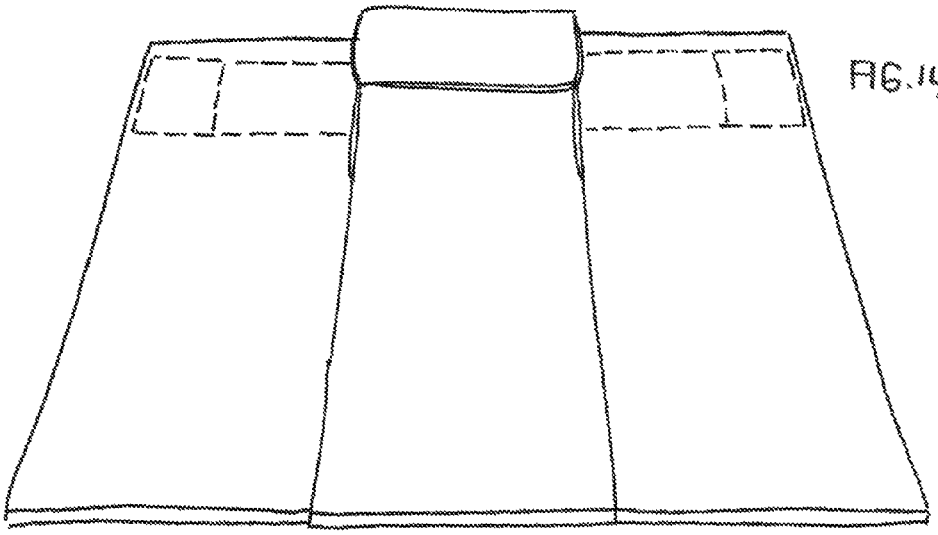
FIG. 14 is a top view of a reversible version of the blanket in accordance with the invention illustrating the headrest portion of the chair, rolled so as to create a pillow.
Figure 15A:
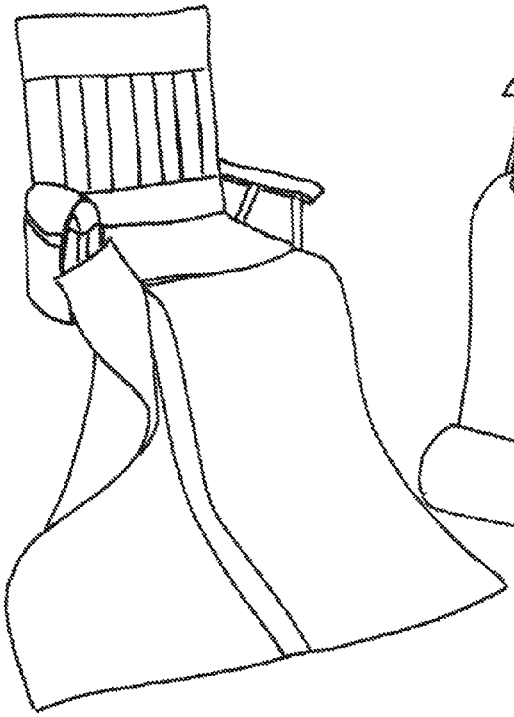
FIGS. 15(*a*), 15(*b*) and 15(*c*) are illustrations of a chair blanket in accordance with the invention, illustrating a partially folded chair blanket, a rolled up chair blanket and a detail of a side pocket on the chair blanket which may be used for storage respectively.

FIG. 12(*a*) and FIG. 12(*b*) show front and rear schematic views of a chair blanket in accordance with the invention, with the back portion, seat portion, the lateral panels and pockets. The components of the zipper are shown at the edge of the lateral panels so that the lateral panels can be joined together when desired. The front view illustrated in FIG. 12(*a*) shows the pair of shoulder panels illustrated in a previous embodiment. These shoulder panels can be manipulated and positioned so as to cover the neck and shoulders, or even the arms, of the user to provide additional warmth and comfort. They may also have pockets which can be used for the hands.

It should be noted that the zipper in several of the embodiments above is shown on the edges of the lateral panels only. However, the position and extent of the zippers, and consequently the extent to which the lateral panels can be closed, can vary widely in accordance with the invention. Therefore, the zipper may run from top to bottom of the lateral panels, and an additional zipper, or the existing zippers, may also extend so as to enable the sealing or closure of the lower end of the blanket to prevent draft or cold from entering the space.

Figure 15:
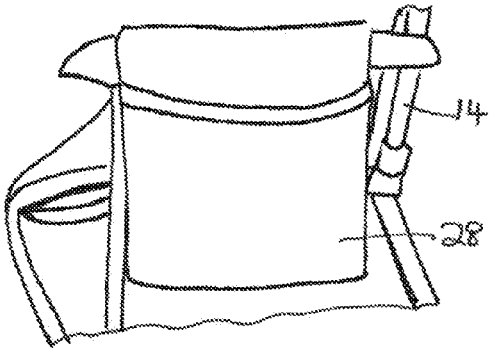

Reference is made to FIG. 15(*a*) which shows a blanket in accordance with the invention mounted on a chair. This figure shows a blanket in accordance with one embodiment of the invention, where the one lateral panel folds first, and the second lateral panel can thereof to be folded so as to lie over, completely or in part, the first folder panel. This figure also shows an embodiment in which a pocket is located on one side of the blanket, but not on the other.

FIG. 15(*b*) shows a rolled up blanket in accordance with the invention, including the position of the strap 12 before it is looped over the rolled up blanket. The strap is connected to the blanket at some convenient point thereof to enable the strap to hold the blanket in the rolled position, but embodiments where the strap may be differently configured or positioned or separated may also be provided. The rolled up blanket will typically be somewhat soft and comfortable, and may thus be used as a pillow in desired circumstances.

FIG. 15(*c*) of the drawings shows a detail view of the panel containing the pocket, attached to the seat portion of the blanket, and thrown over the arm of the chair. The pocket therefore has a twofold advantage. First, it provides a receptacle in which items may be stored by the user, and, second, it provides a softer and warmer surface over the handle or armrest of the armchair, which may be more comfortable than the typical hard plastic or wood or metal arm.

Figure 16:
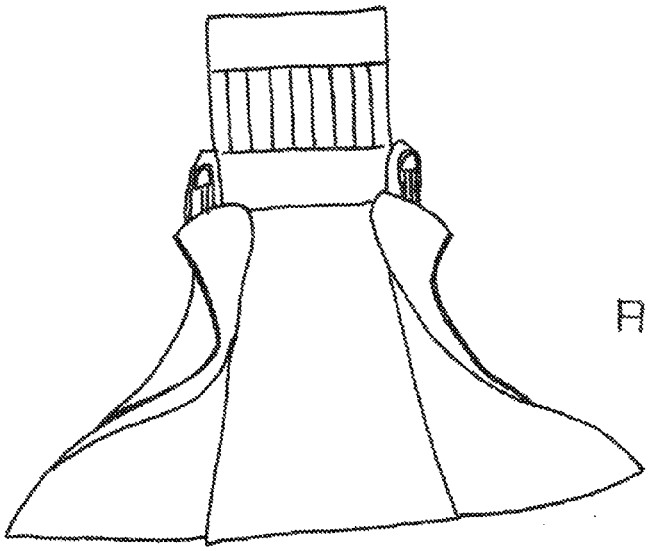
FIG. 16 is an illustration of a chair blanket in accordance with the invention illustrating an unfolded chair blanket mounted on a chair with the front panels unzipped or separated from each other, and ready to receive a user.

FIG. 16 of the drawings shows a front view of a blanket mounted on a folding chair, with the back portion of the blanket having its slip cover fitted over the top of the back of the chair. The seat portion has been unrolled so as to extend upwardly and downwardly, and the lateral panels are shown in the open position. It will be plain that the user is able to sit on the chair on the seat portion, and fold the lateral portions over the legs, so that the legs will be encased in the space, as described above, to provide warmth and comfort.

Figure 17B:
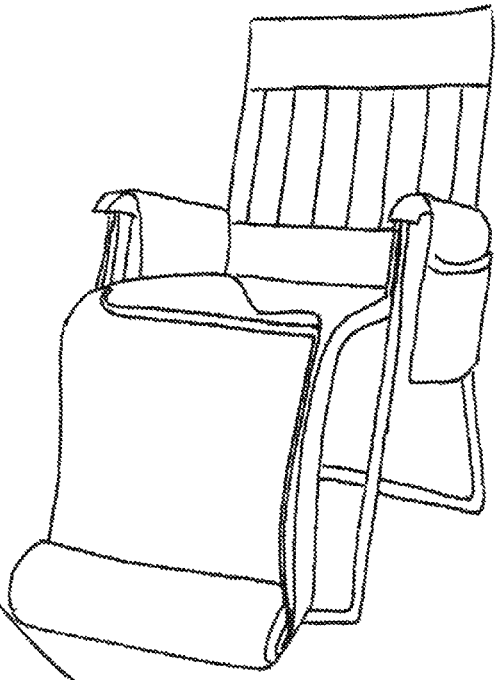
FIGS. 17(*a*) and 17(*b*) are illustrations of a chair blanket in accordance with the invention illustrating a chair or blanket mounted on a chair with a part thereof tucked under the seat portion, and a chair blanket wherein the leg portion is not tucked under the seat portion but unrolled and available for the user respectively.
Figure 17A:
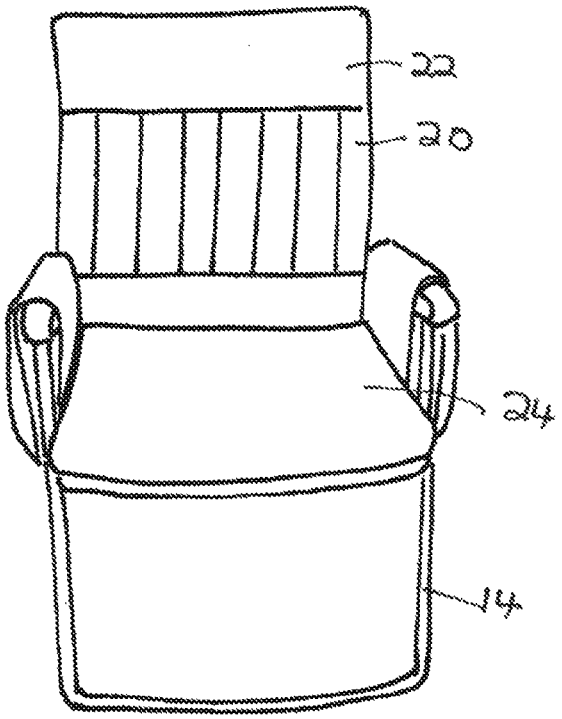

FIG. 17(*a*) shows the arrangement where the blanket is mounted on the folding chair, and the seat portion, including the extendable portion with the lateral panels, is folded over or under the seat panel. It will thus be appreciated that even though the blanket of the invention has the extensible portion for covering the legs when desired, the blanket may be used without the leg coverings, providing a suitable back and seat portion to aid in the comfort of the user. FIG. 17(*b*) shows a perspective view of the chair and blanket somewhat similar to that shown in FIG. 17(*a*) of the drawings, but wherein the tucked in portion has been pulled out and unrolled, at least partially. One of the lateral panels is shown in a part folded position to illustrate its potential function. The extensible portion of the seat portion can be partially unrolled as shown in FIG. 17(*b*), and may act provide partial warmth over desired parts of the body, or even as a windbreaker, or fully unrolled so that the user may put his or her legs in the space by the appropriate folding and unfolding of the lateral panels.

Figure 18:
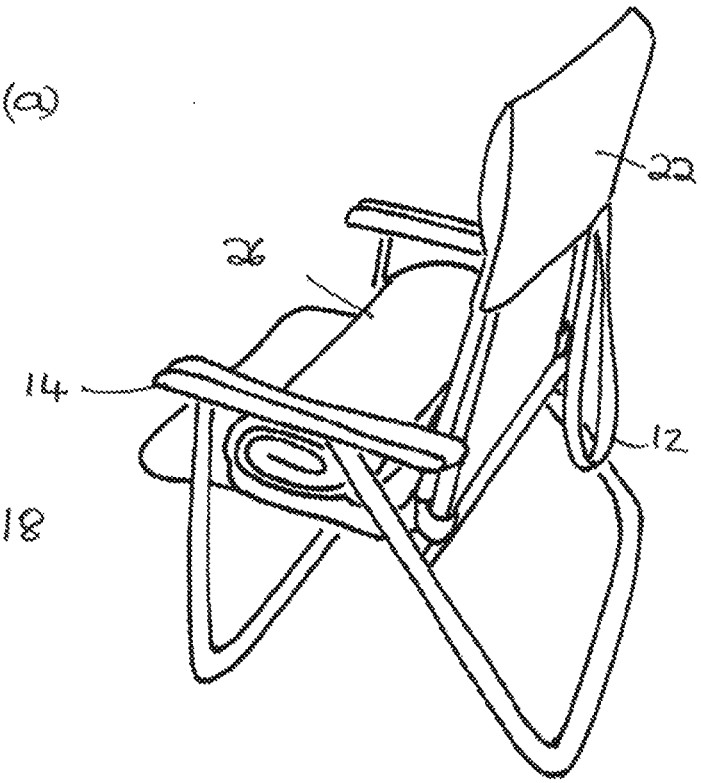
FIG. 18 is an illustration of a chair blanket in accordance with the invention illustrating a chair blanket slipped over the back portion of a chair, partially rolled up in the storage position and positioned on the seat portion of the chair, and the back portion of the chair blanket illustrating the shoulder and lumbar support.

FIG. 18 of the drawings shows a view similar to that in FIG. 2 illustrating the partial attachment of the blanket to the chair. The seat portion is rolled up and placed on the seat, and this may operate as a stored or partially ready condition, or, in the alternative, the rolled up blanket may be used as a pillow to provide additional comfort.

Figure 19:
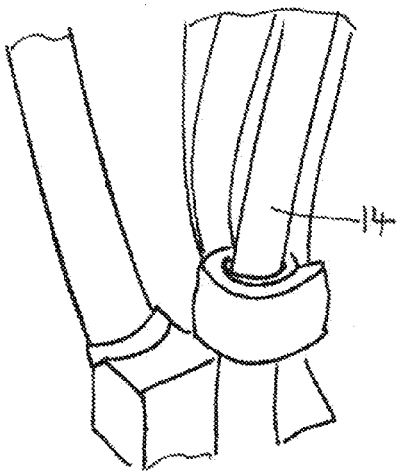
FIG. 19 is a detail view showing the tab with Velcro fastening attached to the metal, aluminum or other material back of a chair.
Figure 15B:
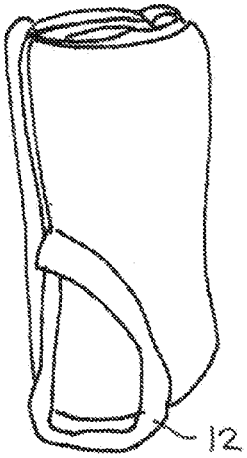

FIG. 19 of the drawings shows a detail including the frame of the chair 14 and the tab which comprises matching surfaces of Velcro fasteners which can releasably be attached to each other in the conventional manner so as to hold the blanket in a relatively stable and secure position on the chair. In this way, the blanket will not during use shift or move around relative to the chair to any significant degree.

Figure 20:
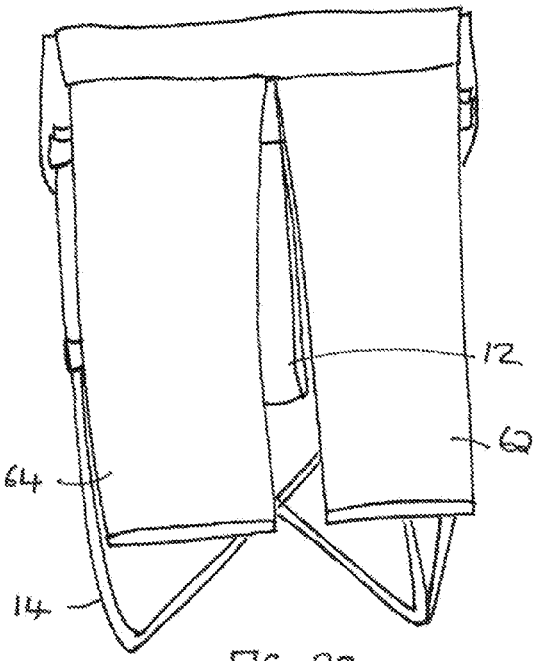
FIG. 20 is a rear view of a chair with the blanket thereon illustrating shoulder panels which have been flipped behind the chair.

FIG. 20 of the drawings shows a rear view of a blanket in accordance with the invention mounted upon a chair 14. This figure illustrates the shoulder panels 62 and 64 hanging behind the chair 14. One or more of the shoulder panels 62 and 64 may be rotated about its connection point to the blanket so that it may be placed in the front over the user sitting in the chair to provide additional warmth and comfort.

Figure 21:
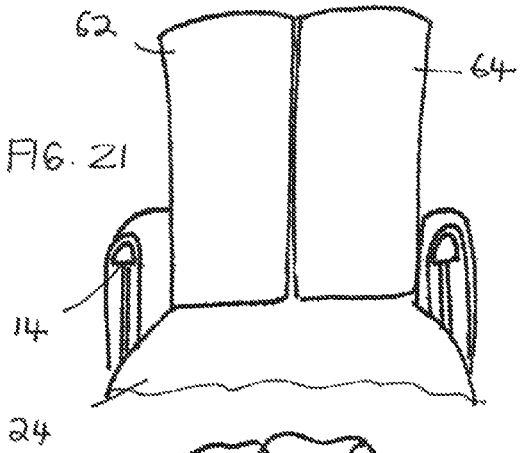
FIG. 21 is a partial view of a chair with the blanket thereon showing a conventional position of the shoulder panels.
Figure 22:
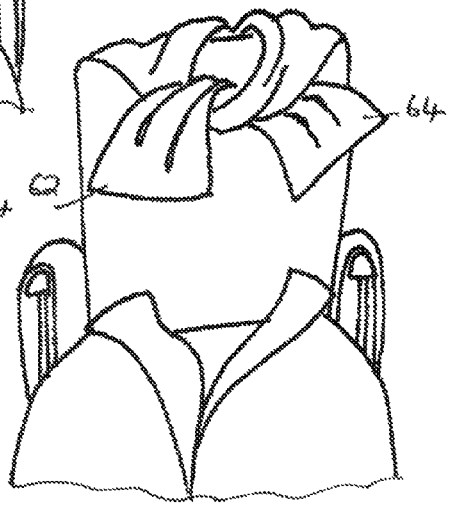
FIG. 22 is a view showing the shoulder panels tied together in one configuration.
Figure 23:
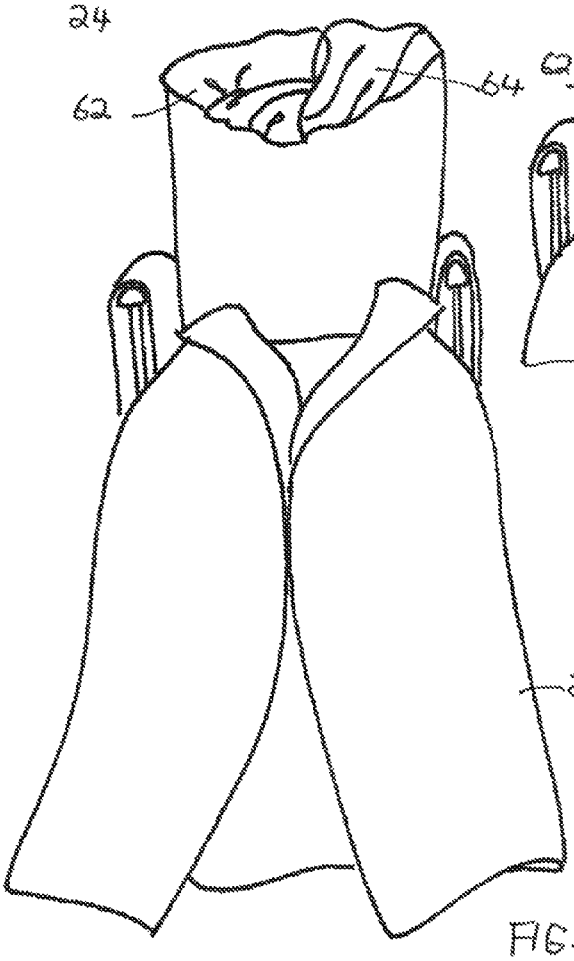
FIG. 23 is a further view showing the embodiment of FIG. 22 with ends of the shoulder panels tucked in so as to create a head, neck or shoulder rest pillow.

FIG. 21 of the drawings shows a front view of the chair 14 with a blanket mounted thereon, and the shoulder pads 62 and 64 hanging in front of the chair, in contrast with the situation illustrated in FIG. 20 of the drawings. The shoulder pads 62 and 64 may be used in different manners, as illustrated in FIGS. 22 and 23 of the drawings. As shown in FIG. 22, the shoulder pads have been tied together in a half knot with the ends of the shoulder panels hanging loosely. These loose ends of the shoulder panels 62 and 64 may be tucked in as illustrated in FIG. 23, thereby creating a head, neck or shoulder rest, and which may function as a pillow of sorts to provide additional comfort to the user, as desired.

The various figures illustrate, as described above, differing embodiments of the chair blanket or foldable blanket of the invention in different modes, configurations and dimensions. Thus, these chair blankets are shown or may be configured so as to be partially folded, rolled up, with items in side pockets, fully zippered, partially zippered, and unzipped, to name a few positions without intending to limit the scope and function of the blanket of the invention. It should be noted that Velcro may be used to replace zippers completely on the blanket or for only a portion thereof.

While the accompanying drawings and illustrations show various embodiments of the invention, it is to be noted, however, that many different or additional embodiments may be feasible within the scope of the invention.

Therefore, the invention provides a combination cushion and blanket for a chair, or to be used independently of a chair, comprising a seat portion, a back portion, a shoulder portion, and a blanket portion preferably attached to the seat portion, the blanket portion being foldable and adjustable so that it can be used to cover the legs or other parts of the body, as desired. Further, pockets may be attached to the seat portion, for example, and the pockets may swing over and hang from armrests which may be a component of the chair.

The various portions and components of the combination chair cushion and blanket may be rolled or folded so as to be easily transportable, and also suitable for convenient storage purposes. At least the seat portion, and possibly the back portion, may have additional cushioning to provide for the further comfort of the user.

The combination chair cushion and blanket may have its components and portions of differing relative dimensions so that a particular chair cushion and blanket in accordance with the invention may be constructed to fit any one of a wide range of chairs having varied sizes and shapes.

Throughout this description, the embodiments and examples shown should be considered as exemplars, rather than limitations on the apparatus and procedures disclosed or claimed. Although many of the examples presented herein involve specific combinations, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A blanket comprising:

a seat portion having opposing sides, a front edge and a back edge, a back portion having a lower edge, an upper edge, and a pair of side edges, the lower edge of the back portion being fastened to the back edge of the seat portion, with the upper edge and side edges of the back portion being unattached free edges, a first extended leg portion attached to one side of the seat portion only and a second extended leg portion attached to an opposing side of the seat portion only, each of the first and second leg portions extending from its attachment at the one side to substantially the opposing side of the seat portion and being movable between a first position in which they are moved off the seat portion and a second position in which they cover the seat portion and overlap with each other, the first and second leg portions being foldable and adjustable so that they can be used to cover the legs, as desired, a pair of shoulder panels extending from the upper edge of the back portion, wherein the shoulder panels are configured to be folded and tied into a pillow, head or neck rest.

2. A blanket as claimed in claim 1 further comprising one or more pockets attached to the seat portion, wherein the pockets may swing over and hang from chair armrests.

3. A blanket as claimed in claim 1 wherein the blanket may be rolled or folded so as to be easily transportable, and also suitable for convenient storage purposes.

4. A blanket as claimed in claim 1 wherein at least the seat portion and the back portion have additional cushioning for the further comfort of the user.

5. A blanket as claimed in claim 1 wherein the seat, back and leg portions are of differing relative dimensions so that a particular blanket may be constructed to fit any one of a wide range of chairs having varied sizes and shapes.

6. A blanket as claimed in claim 1 further comprising at least one lumbar support.

7. A blanket as claimed in claim 6 wherein the lumbar support is located on the back portion and is comprised of polyester fiber fill, the polyester fiber fill being secured with top stitching.

8. A blanket as claimed in claim 1 wherein the blanket is configured for mounting on a chair.

9. A blanket as claimed in claim 1 wherein the chair is a folding chair having a seat portion, a back portion and a pair of lateral armrests.

10. A blanket as claimed in claim 9 further comprising a slipcover or fold over portion for releasably sliding over and engaging the back portion of the chair.

11. A blanket as claimed in claim 1 wherein the back portion, seat portion and leg portion can be rolled up into a stored position, the blanket further comprising a strap for holding the rolled up blanket in the stored position.

12. A blanket as claimed in claim 1 wherein the leg portion comprises a base panel and a pair of lateral panels, the lateral panels being connected to the base panel along outer edges of the base panel respectively, the lateral panels having a fastening means along at least a part of a free edge thereof so that the lateral panels can be selectively fastened to each other to create at least a partially closed space between the base panel and the lateral panels.

13. A blanket as claimed in claim 1 wherein the leg portion comprises a base panel and a pair of lateral panels, the lateral panels being connected to the base panel along outer edges of the base panel respectively, the lateral panels being foldable over the base panel to create at least a partially closed between the base panel and the lateral panels.

14. A blanket as claimed in claim 1 further comprising one or more pockets attached to the seat portion, wherein the pockets hang from the seat portion.

* * * * *